US006813593B1

(12) United States Patent
Berger

(10) Patent No.: US 6,813,593 B1
(45) Date of Patent: Nov. 2, 2004

(54) ELECTRO-OPTICAL, OUT-DOOR BATTLE-FIELD SIMULATOR BASED ON IMAGE PROCESSING

(75) Inventor: Yossi Berger, D.N. Misgav (IL)

(73) Assignee: Rafael-Armament Development Authority Ltd., Haifa (IL)

( * ) Notice: Subject to any disclaimer, the term of this patent is extended or adjusted under 35 U.S.C. 154(b) by 918 days.

(21) Appl. No.: 09/708,641

(22) Filed: Nov. 9, 2000

(30) Foreign Application Priority Data

Nov. 17, 1999 (IL) ..... 132997
Aug. 25, 2000 (IL) ..... 138097

(51) Int. Cl.[7] ..... F41G 3/26

(52) U.S. Cl. ..... 703/6; 434/19; 434/22; 434/12; 434/20

(58) Field of Search ..... 703/6; 434/19, 434/22, 12, 20

(56) References Cited

U.S. PATENT DOCUMENTS 4,439,156 A * 3/1984 Marshall et al. ..... 434/12
4,793,811 A * 12/1988 Eichweber ..... 434/22
4,824,374 A * 4/1989 Hendry et al. ..... 434/22
5,215,465 A * 6/1993 Marshall et al. ..... 434/22
6,322,365 B1 * 11/2001 Shechter et al. ..... 434/21

FOREIGN PATENT DOCUMENTS

DE 3405017 A 8/1985
FR 2772908 12/1997

* cited by examiner

*Primary Examiner*—Anthony Knight
*Assistant Examiner*—Sunray Chang
(74) *Attorney, Agent, or Firm*—Mark M. Friedman

(57) ABSTRACT

A simulator for simulating the firing of a weapon at one or more targets, each target having a respective shape. The simulator includes a housing substantially identical in size and shape to at least a discrete portion of the weapon. The simulator further includes a sensor, operationally connected to the housing, for acquiring a number of images of at least one of the targets. The simulator also includes an image processor for detecting and analyzing change among the images and for initiating control signals based on the analysis.

16 Claims, 3 Drawing Sheets

Battle field
Simulator for EO ATMS

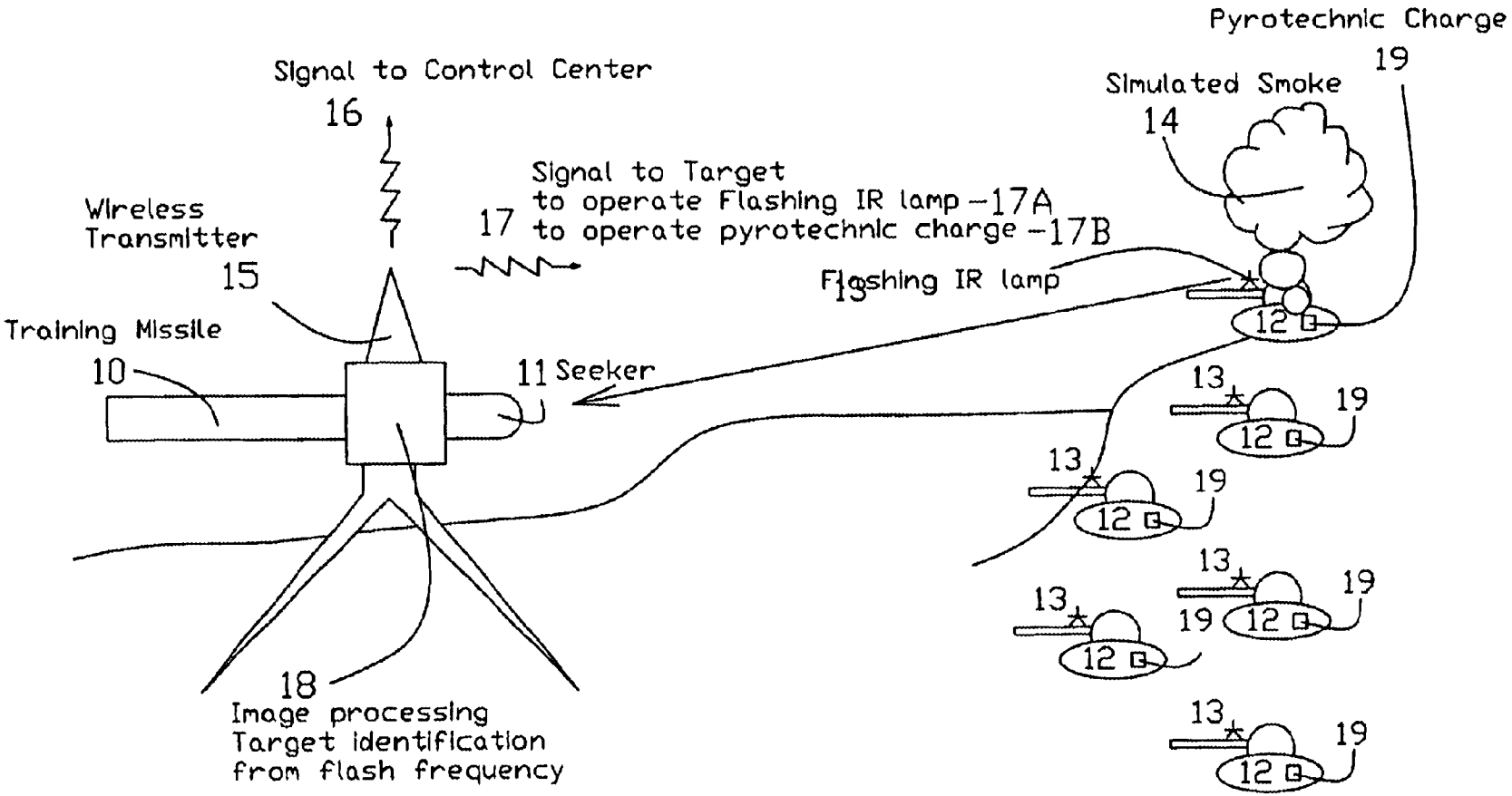
Fig. 1 - Battle field Simulator for ED ATMS

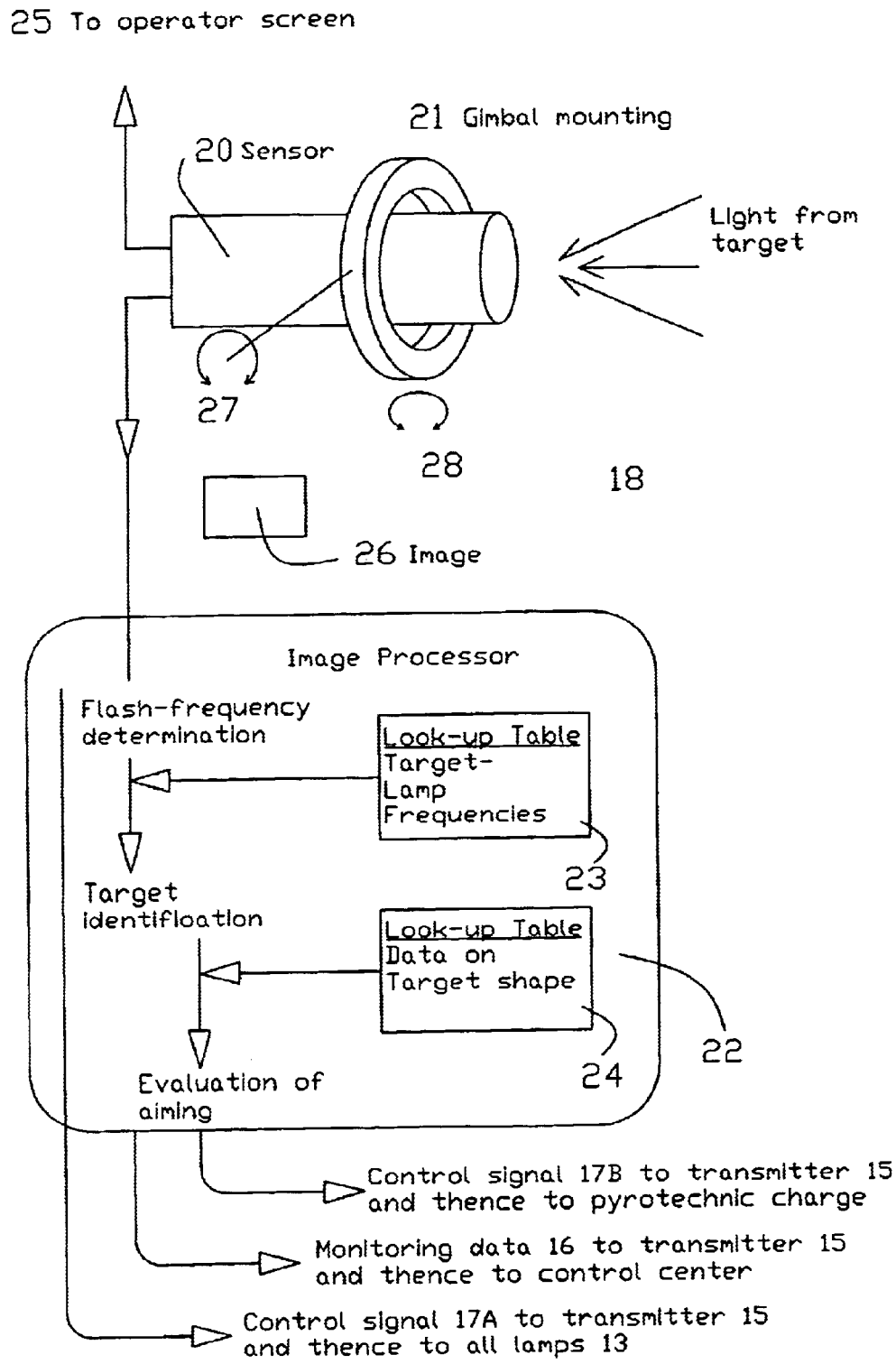
Fig. 2 - Schematic of Operation of Seeker Head and Image Processor

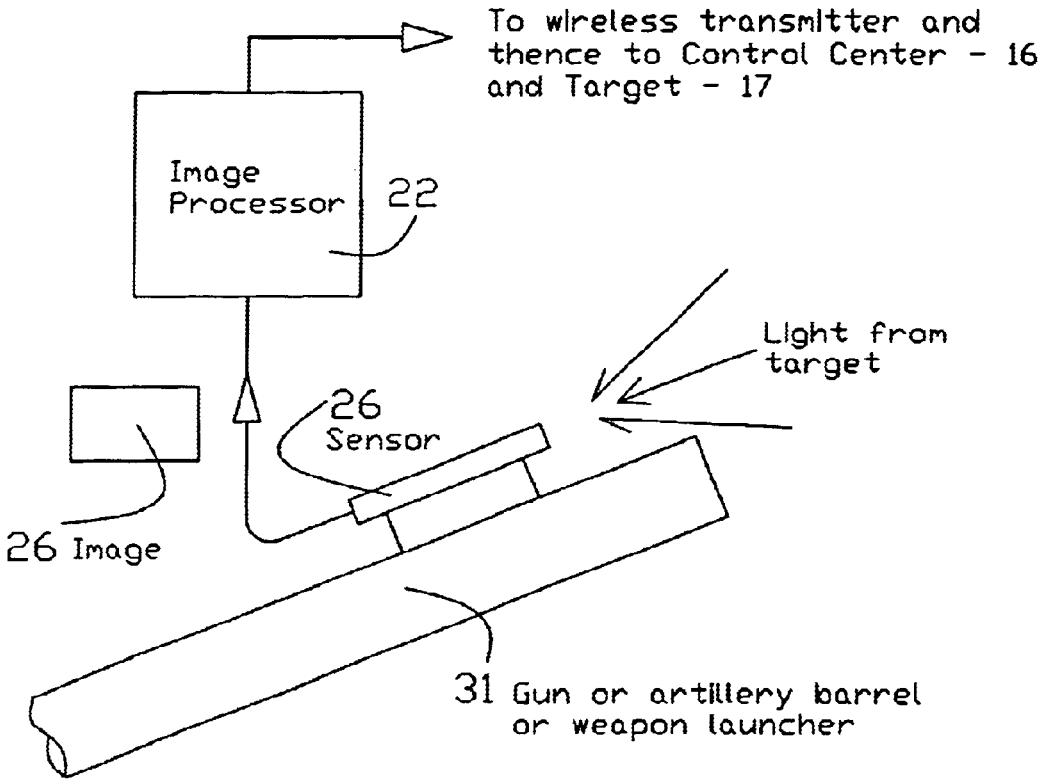
Fig. 3 - Implementation for non-EO guided weapons

ELECTRO-OPTICAL, OUT-DOOR BATTLE-FIELD SIMULATOR BASED ON IMAGE PROCESSING

FIELD AND BACKGROUND OF THE INVENTION

The present invention relates to a military training system for firing a weapon at a target and, more particularly, to a training system for firing an electro-optically guided anti-tank missile.

SIMULATION IN TRAINING

Military training exercises use simulation, wherever possible, rather than live ammunition or actual firing of weapons, both to save costs and to avoid unnecessary use of dangerous equipment More realistic simulation lends greater verisimilitude and helps train soldiers in conditions that more closely resemble battlefield conditions. Thus, in firing exercises, a soldier needs to aim a weapon, pull a trigger or otherwise activate firing, and see the results of a "hit".

A further requirement is that a training control center be able to monitor all training activities, if possible, in real time.

To heighten the sense of reality, there is a need for battlefield simulation systems that are integrated with armament systems and not intrusive add-ons.

CURRENTLY AVAILABLE SIMULATION OF WEAPON SYSTEMS

Current weapons firing simulation systems employ a laser installed on the weapon that makes it possible to simulate firing, using a laser pulse instead of ammunition, and to identify the target hit.

In the case of anti-tank missile systems (ATMS), current simulations employ a pulsed laser, which is attached to and aligned with the missile launcher and which is fired instead of a missile. Detectors placed on the target are illuminated by the laser, may record a hit, and can relay that information both to the operator of the missile and to the training control center. This method is used in, for example, the Swedish BT46 system from Saab Training Systems.

The same system can also be attached to various types of guns and artillery and operated similarly.

This is a suitable approach for rigid, so-called "stiff-neck" weapons, whose aiming is restricted to the direction of a sensor fixed relative to the missile, but not for the new generation of ATMS which feature "flexible neck" seekers, whose sensors have an overall wider field of view obtained by varying the sensor orientation relative to the missile's canister axis. The problem here is that there is not necessarily any connection between the line of sight of the launcher and that of the seeker head.

Drawbacks of current simulation systems include:

Rigid laser alignment: Being attached rigidly outside the missile or gun barrel, the laser mimics the launcher operation but not that of the separate target seeker, which is located in the seeker head of the missile and operates independently of the launcher before and after firing. A sensor in the seeker head is mounted on gimbals and can alter its pitch and yaw with respect to missile orientation and the target position, as required, in order to lock onto a desired target, something the launcher-mounted laser is unable to do. The situation may be likened to a light on a miner's helmet that may not necessarily be illuminating the spot where the miner is actually looking. Thus, a laser "hit" is not necessarily indicative of a missile hit; nor does a laser "miss" necessarily indicate a missile miss.

The laser apparatus is a relatively heavy and cumbersome add on. It requires calibration before use and is not easy to use.

The laser apparatus is hazardous to human eyesight.

The laser apparatus is limited by adverse weather conditions.

Thus there is a recognized need for, and it would be highly advantageous to have, a training system that is better integrated with and better simulates the missile's target-seeking operation, itself, and that is safer, less intrusive and cumbersome, and less adversely affected by weather conditions.

SUMMARY OF THE INVENTION

According to the present invention there is provided a simulator for simulating the firing of a weapon at one of a plurality of targets, each target having a respective shape, including: a housing substantially identical in size and shape to at least a discrete portion of the weapon; a sensor, operationally connected to the housing, for acquiring a plurality of images of at least one of the targets; and an image processor for detecting and analyzing changes among the images and for initiating control signals based on the analysis.

According to further features of the invention described below there is included: for each target, an infra-red lamp that is alternatively activated by one of the control signals to flash at a unique, respective frequency and deactivated by another of the control signals; and a mechanism for transmitting the control signals to the lamps.

According to a preferred embodiment of the present invention, the transmitting mechanism is wireless.

According to another preferred embodiment of the present invention, the transmitting mechanism is wired.

According to a preferred embodiment of the present invention, the sensor includes a CCD television camera.

According to further features in preferred embodiments of the invention, the sensor forms part of the guidance system of an electro-optically guided missile.

According to further features of the present invention, there is provided a look-up table for the image processor including data about shapes of the targets and a capability of the image processor to utilize the data to calculate accuracy of aim at a target.

According to further features in preferred embodiments of the invention, there is provided, at each target, a pyrotechnic charge that is detonatable by a respective control signal and that is able to release variable quantities of smoke in accordance with the calculated accuracy of aim According to the present invention, there is provided a method for identifying an acquired target comprising the steps of: (a) providing a weapon simulator including a housing substantially identical in size and shape to at least a discrete portion of the weapon; a sensor, operationally connected to the housing, for acquiring a plurality of images of a target; an image processor for detecting and analyzing changes among these images and for initiating control signals based on the analysis; for each target an infra-red lamp that is alternatively activated by one of the control signals to flash at a unique, respective frequency and deactivated by another of the control signals; and a mechanism for transmitting the control signals to the lamps; (b) aiming the housing at one of the targets; (c) transmitting a signal to activate all the infra-red lamps; (d) acquiring the plurality of images, at known time intervals, of the target aimed at; (e) passing the images to the image processor, (f) calculating the flash frequency of the lamp on the target aimed at by comparing successive images from the sensor, and (g) identifying the target aimed at by comparing the frequency with a look-up table of the unique frequencies.

According to further features of the present invention there is provided a method for determining accuracy of aim.

According to further features of the present invention there is provided a method for determining accuracy of aim comprising the further steps of providing a target-shape look-up table that includes data about the shapes of the respective targets and comparing the sensor images of an acquired target with the shape data.

According to a preferred embodiment of the present invention there is provided a method for a visual simulation of a hit.

According to a preferred embodiment of the present invention there is provided a method for a visual simulation of a hit comprising the steps of providing, at each target, a pyrotechnic charge and detonating the charge at an identified target.

According to preferred embodiment of the present invention there is provided a method for visually simulating the accuracy of a hit comprising the further step of differentially detonating the charge.

According to another embodiment of the present invention there is provided a method for simulation of firing of ballistic weapons.

According to another embodiment of the present invention there is provided a method for simulation of firing of ballistic weapons. Comprising the further step of providing calculation algorithms for the image processor that include calculation of parabolic trajectories incorporating known muzzle velocities, angle of elevation, and range of said target.

BRIEF DESCRIPTION OF THE DRAWINGS

The invention is herein described, by way of example only, with reference to the accompanying drawings, wherein:

FIG. 1 shows a configuration for battlefield training for electro-optically guided anti-tank missile systems;

FIG. 2 is a schematic representation of the guided missile's seeker head, showing the essential components of the present invention; and FIG. 3 shows an implementation for non-electro-optically guided weapons.

DESCRIPTION OF THE PREFERRED EMBODIMENTS

Introduction

The present invention is of an outdoors military training system for firing a weapon at a target, which provides for interaction between the training weapon and the target. Specifically, the present invention can be used for field training for electro-optically guided anti-tank missile systems. The present invention incorporates reporting mechanisms so that a training control center can be instantly aware of the results of training exercises. The present invention is a substitute for, or additional to, the currently used BT46 system, which is based on laser mechanisms.

The present invention may also be adapted to field training for other types of guns and artillery.

The present invention utilizes the in-built target seeking mechanism of ATMS, with the addition of a light-weight, inexpensive, and unobtrusive image processor.

According to the present invention, operation relies on identification of the frequency of a flashing infra-red lamp located on an acquired target identification is done by means of the image processor fed by the seeker sensor, such as a television camera in the missile's own target-seeker head, or by an add-on sensor.

The principles and operation of the present invention may be better understood with reference to the drawings and the accompanying description.

Configuration and operation

In general, the simulated weapon is a housing that represents, in shape and size, a discrete portion of a real weapon, and sufficient of the launcher to enable training aiming and firing. It includes a missile guidance system but neither propulsion system nor explosive charge. FIG. 1 shows a schematic view of the present invention in operation, for the case of an ATMS, and FIG. 2 a block diagram of the relevant parts of the missile's seeker head and the image processor.

The electro-optical guidance system of a missile simulator 10 includes a sensor 20, such as a CCD television camera or imager, in the seeker head 11 thereof. In practice, the missile simulator could be an actual missile, less the propulsion system and explosive charge thereof.

In normal use, sensor 20, which is sensitive to infra-red and visible light, captures an image 26 of a target 12. Sensor 20 is mounted on gimbals 21, which are an intrinsic part of the seeker, so that the pitch 27 and yaw 28 thereof may be varied to enable sensor 20 to see or to lock onto target 12.

In the present invention, each potential target 12 is equipped with a respective flashing infra-red lamp 13 mounted thereon, which is invisible to the operator's eye but detectable by sensor 20 (CCD television camera or IIR imager). The flashing frequency is unique to each particular target 12 whereupon each lamp 13 is located.

Successive images 26 from sensor 20 are passed, at predetermined time intervals, to an image processor 22 that detects changes among images 26. The time intervals are short enough to enable image processor 26 to calculate the flash frequency of lamp 13, and, by comparison with a pre-programmed look-up table 23, to identify at which target missile 10 is 'aiming'. By comparison with data, contained in a second look-up table 24, about the shape and size of the targets, image processor 22 also determines the accuracy of aiming. This information is relayed by a wireless signal 17 to target 12, in order to detonate a pyrotechnic charge 19 situated at target 12 to simulate a 'hit' by releasing smoke 14. A second wireless signal 16 is transmitted to a training control center, in order to enable trainers to monitor and control the training program and also to rate a trainee.

In more detail, the stages of operation are:

1. Weapon simulator 10 is aimed at target 12.
2. Seeker head 11 acquires target 12 and the operator locks onto target 12. At that moment wireless transmitter 15 transmits a signal 17A to all targets and activates an infra-red lamp 13 located on each target. Each lamp 13 flashes at a unique frequency specific to the associated target thereof.
3. Simultaneously, sensor 20 passes a sequence of images 26, at predetermined time intervals, of target 12, including flashing lamp 13, to image processor 22.

4. Image processor 22 calculates the frequency of lamp 13 on acquired target 12 by comparing successive images and, by comparing the frequency with an in-built look-up table of respective target frequencies 23, identifies which target has been acquired.
5. Having thus identified target 12, image processor 22 performs a further comparison of image 26 of target 12 with target-shape data 24 stored within image processor 22 to estimate aiming precision.
6. When the trainee operator is satisfied with his aim, he 'fires' the missile, which does not actually launch. Instead, a signal 17B is sent by transmitter 15 to detonate associated pyrotechnic charge 19 located at target 12, releasing smoke 14, to simulate a 'hit'. The charge is differentially detonatable: it is possible to vary the amount of smoke in accordance with the accuracy of aim to provide a visual representation of that accuracy.
7. Information about the launcher, the target 'hit', and the accuracy of aim is transmitted to simulation control center 16 to update the data held there.
8. Preferably, the entire target-acquisition process is recorded at the control center on videotape for later debriefing.
9. The system allows for simulation of the times of flight and probability of hitting a target, for the purpose of simulation of various types of munitions (such as missile, shell, bullet, etc).

It is seen that the invention, by utilizing the missile's in-built sensor, solves the problem of the difference between the missile line of sight, which may vary in flight, and that of an externally attached laser, as occurs in existing systems.

Furthermore, the invention, by utilizing a passive, already in-built sensor such as a CCD camera, has advantages of weight, safety (no laser beam), operational simplicity (calibration is not needed as it would be for a separate laser system aligned with the missile), debriefing (possibility of video record), low cost (less technically complicated), and better visibility in adverse weather conditions (CCD is more sensitive than the human eye and is less affected by atmospheric conditions than lasers).

Moreover, since the present invention is normally integrated into the simulated weapon and is therefore unobtrusive, there is the consequence that a conventional laser, may be added to the simulated weapon to facilitate integration into conventional battlefield simulators that use laser or other techniques such as in the earlier mentioned BT46 system. This adds versatility to the invention.

In another embodiment, the present invention is partially realized by a simpler system, in which the image processing stage is employed without sending a signal 16 back to the control center and/or the target 12 by use of transmitter 15, which may therefore be absent.

In yet another embodiment of the present invention, wireless communication is replaced with wired transmission of signals and data In this case, transmitter 15 is absent and is replaced by cables.

Yet another embodiment of the present invention is for non-electro-optically guided weapons systems, such as rifles and artillery. In such a ballistic implementation, wherein a gun or cannon is substituted for the launcher, there is no missile, and a sighting mechanism substitutes for the guidance system. In such cases, 'discrete portion' of the weapon includes only the gun or cannon and the sighting mechanism and 'aiming' means pointing the housing so that, if it were a real weapon, a projectile fired therefrom would follow a trajectory to the target; thus the sensor needs to be adjustable for range and other considerations in the same way as sights on a real weapon. In this embodiment, as illustrated in FIG. 3, there is no signal from sensor 20 to an operator's screen and sensor 20 is not mounted on gimbals but is secured rigidly to a weapon barrel 31. An inexpensive, light-weight CCD television camera sensor is less obtrusive than a laser, as used in current systems. In this case, the aforementioned provision mentioned in stage of operation 9, for simulation of time of flight etc comes into play to cope with the case of ballistic projectiles, wherein the sensor points at the target while the gun barrel does not because the projectile describes a parabolic trajectory. All needed details for the simulation are calculated from positional data.

While the invention has been described with respect to a limited number of embodiments, it will be appreciated that many variations, modifications and other applications of the invention may be made.

What is claimed is:

1. A simulator for simulating the firing of a weapon at one of a plurality of targets, each target having a respective shape, comprising:

a) a housing substantially identical in size and shape to at least a discrete portion of the weapon;

b) a sensor, operationally connected to said housing, for acquiring a plurality of images of at least one of the targets; and c) an image processor for detecting and analyzing changes among said images and for initiating control signals based on said analysis d) for each target, an infra-red lamp that is alternatively:

i) activated by one of said control signals to flash at a unique, respective frequency and ii) deactivated by another of said control signals: and e) a mechanism for transmitting said control signals to said lamps whereby analysis by said image processor of light produced by a said infra-red lamp and detected by said sensor indicates at which target from amongst said plurality of targets said housing has been, thus accurately simulating the aiming step of the firing of the weapon.

2. A system of claim 1 in which said mechanism is wireless.

3. The system of claim 1 in which said mechanism is wired.

4. The system of claim 1 in which said sensor includes a CCD television camera.

5. The system of claim 1, in which said sensor includes part of a guidance system of an electro-optically guided missile.

6. The system of claim 1, wherein said image processor includes a look-up table that includes data about shapes of respective said targets, said image processor being operative to calculate an accuracy of an aim at the target whereat the firing of the weapon is simulated.

7. The system of claim 1 further comprising:

d. at each target, a pyrotechnic charge that is detonatable by a respective said control signal.

8. The system of claim 7, wherein said image processor includes a look-up table that includes data about shapes of respective said targets, said image processor being operative to calculate an accuracy of an aim at the target whereat the firing of the weapon is simulated.

9. The system of claim 8, wherein said pyrotechnic charge is differentially detonatable in accordance with said accuracy of aim calculation.

10. A method of simulating the firing of a weapon at one of a plurality of targets, comprising the steps of:

a) providing:

(i) a weapon simulator including a housing substantially identical in size and shape to at least a discrete portion of the weapon;

(ii) a sensor, operationally connected to said housing, for acquiring a plurality of images of the target; and (iii) an image processor for detecting and analyzing changes among said images and for initiating control signals based on said analysis;

(iv) for each target, an infra-red lamp that is alternatively:

(A) activated by one of said control signals to flash at a unique, respective frequency and (B) deactivated by another of said control signals; and (v) a mechanism for transmitting said control signals to said lamps;

b) aiming said housing at one of the targets;

c) activating all said infra-red lamps;

d) acquiring a plurality of images, at predetermined time intervals, of the target whereat said housing is aimed;

e) passing said images to said image processor;

f) calculating a flash frequency of the lamp on the target whereat said housing is aimed, by comparing successive said images; and g) identifying the target whereat said housing is aimed, by comparing said calculated flash frequency with a look-up table of said respective frequencies whereby said identifying at which target from amongst said plurality of targets said housing has been aimed is an accurate simulation of the aiming step of firing of the weapon.

11. The method of claim 10, further comprising the step of:

h) visually simulating a hit.

12. The method of claim 11, wherein said simulating is effected by steps including:

i) providing, at each target, a pyrotechnic charge; and ii) detonating said charge at the target whereat said housing is aimed.

13. The method according to claim 12, wherein said charge is detonated differentially.

14. The method of claim 10, further comprising the step of:

h) determining an accuracy of said aim.

15. The method according to claim 14, wherein said determining of said accuracy is effected by steps including:

i) providing a look-up table that includes data about shapes of the targets; and ii) comparing said images of the target with said shape date.

16. The method of claim 14, wherein said determining of said accuracy is effected by steps including calculating a trajectory from said housing to the target whereat said housing is aimed.

* * * * *